United States Patent [19]

Gradi

[11] 4,242,891

[45] Jan. 6, 1981

[54] PNEUMATIC TAKE-DOWN DEVICE FOR A CIRCULAR KNITTING MACHINE

[75] Inventor: Enzo Gradi, Florence, Italy

[73] Assignee: Brematex S.p.A., Prato, Italy

[21] Appl. No.: 900,762

[22] Filed: Apr. 27, 1978

[30] Foreign Application Priority Data

Apr. 29, 1977 [IT] Italy ..... 9427 A/77

[51] Int. Cl.[3] ..... D04B 15/92

[52] U.S. Cl. ..... 66/149 S

[58] Field of Search ..... 66/149 S; 302/2 R; 406/33 (U.S. only), 84 (U.S. only)

[56] References Cited

U.S. PATENT DOCUMENTS

| | | | |
|---|---|---|---|
| 2,975,622 | 3/1961 | Booton et al. | 66/149 S |
| 3,063,275 | 11/1962 | Luchi | 66/149 S |
| 3,248,071 | 4/1966 | Cook | 302/2 R X |
| 3,738,123 | 6/1973 | Mazzi | 66/149 S |
| 3,858,417 | 1/1975 | Uhlir et al. | 66/149 S |

FOREIGN PATENT DOCUMENTS

| | | | |
|---|---|---|---|
| 314835 | 11/1971 | U.S.S.R. | 66/149 S |

*Primary Examiner*—Wm. Carter Reynolds

*Attorney, Agent, or Firm*—Richards, Shefte & Pinckney

[57] ABSTRACT

A pneumatic take-down device for a circular knitting machine of the rotating cylinder type has a take-down tube mounted in the cylinder for rotation therewith and opens into an article receiving chamber in a housing that is mounted on the tube for rotation therewith. Suction is applied to the housing through perforations so that a suction take-down tension is applied to an article being knit to draw the article into the housing chamber and retain it therein without relative twisting during the knitting operation. The tube opens transversely to feed articles transversely to the perforations and also opens across the tube for in line discharge of articles through a discharge opening in the housing when suction is drawn through the discharge opening and discontinued through the perforations upon completion of knitting of an article. The tube has a cylindrically reduced portion adjacent the needle end of the cylinder for concentrated article tensioning suction thereat.

6 Claims, 5 Drawing Figures

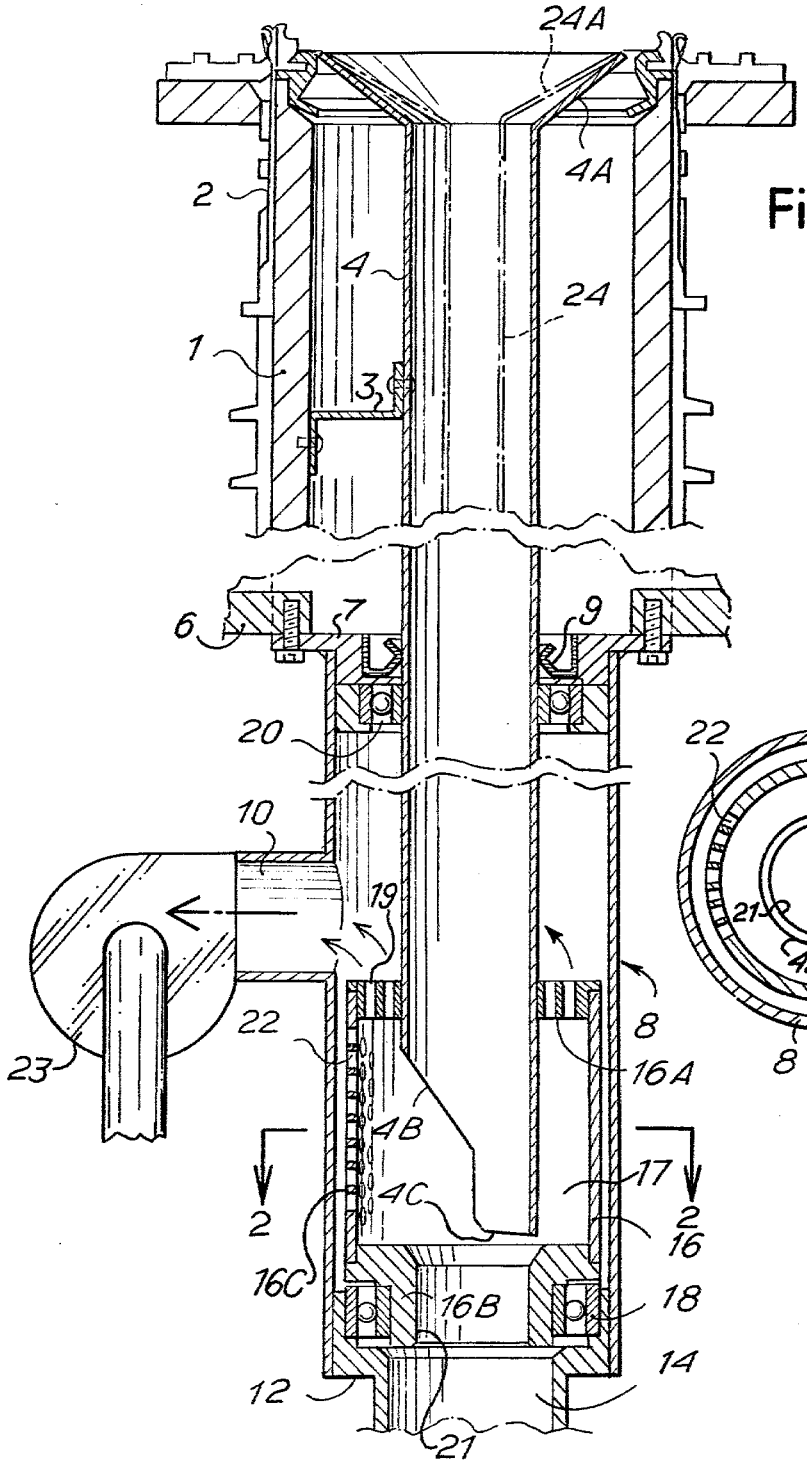
Fig. 1
Fig. 2
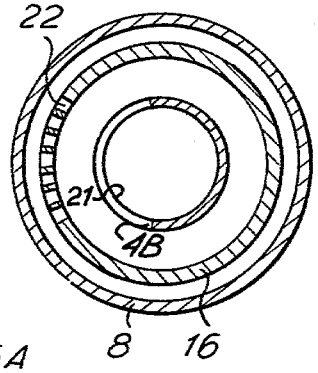

PNEUMATIC TAKE-DOWN DEVICE FOR A CIRCULAR KNITTING MACHINE

BACKGROUND OF THE INVENTION

Take-down devices have long been used for drawing knit fabric away from the needles of a circular knitting machine during knitting and to apply tension to the fabric for effective knitting operation.

These prior take-down devices either are complicated mechanical devices that include gripping mechanisms that close and open to grip and release articles during the knitting operation and advancing mechanisms or weight that apply the take-down tension, or are simpler pneumatic devices that apply a take-down tension.

In either case, the rotation of the needle cylinder, particularly at the increasing speeds of rotation being developed for increased production, causes an undesirable twisting of the fabric during take-down, which is accentuated when knitting articles that are appreciably longer than the take-down tube itself and are therefore subjected to the relative twisting effect imposed by the non-rotating machine components beyond the take-down tube.

SUMMARY OF THE INVENTION

The present invention is directed to the elimination of twisting and the inherent disadvantages thereof that are common to prior art take-down devices, by providing a device that retains articles for continued rotation with the needle cylinder during take-down without relative twisting and does so in a relatively short take-down length even when knitting relatively long articles. Furthermore, the advantages are obtained by this invention with the use of a simple pneumatic device.

Briefly described, the pneumatic take-down device of the present invention includes a take-down tube mounted in the rotating needle cylinder of a knitting machine for rotation therewith. A housing is mounted on the tube for rotation therewith and has an article receiving chamber in to which an end of the tube opens. The housing has perforations therein and means for selectively applying suction acts through the perforations to impose a take-down suction to an article in the tube and to retain in the chamber the portion of an article being knit that feeds from the tube into the chamber for rotation with the housing and tube without relative twisting. The housing further has an article discharge opening separate from the perforations for discharge of articles therethrough from the housing upon discontinuance of suction through the perforations. With this arrangement, take-down tension is effectively applied to an article being knit and the article is retained for rotation with the needle cylinder without any undesirable twisting, and yet a relatively short take-down tube can be utilized for this purpose regardless of the length of article being knit.

In the preferred embodiment of the present invention, the tube projects through an end wall of the housing and the perforations are formed in that end wall for drawing of the article being knit thereto. The effected drawing of the article from the tube is further facilitated by the tube end opening transversely and, if desired, perforations can also be included in a wall portion of the housing facing the transverse opening in the tube end. The discharge opening is preferably arranged in coaxial alignment with the tube for in line discharge of articles through the tube, housing and discharge opening, and the tube end opens thereacross in alignment with the article discharge opening for such in line discharge as well as opening transversely for feeding of articles to the perforations. The means for selectively applying suction is alternatively operable to draw suction through the discharge opening to discharge articles through the tube, housing and discharge opening upon discontinuance of the suction through the perforations upon completion of the knitting of an article. For enhanced take-down effectiveness, the tube is provided with a cylindrically reduced portion adjacent the article receiving end of the tube for concentrated article tensioning suction thereat.

BRIEF DESCRIPTION OF THE DRAWINGS

FIG. 1 is a vertical sectional view of the pertinent portions of a circular knitting machine in which the preferred embodiment of the pneumatic take-down device of the present invention is incorporated;

FIG. 2 is a horizontal sectional view taken along line 2—2 of FIG. 1;

DETAILED DESCRIPTION OF THE PREFERRED EMBODIMENT

Figure 3:
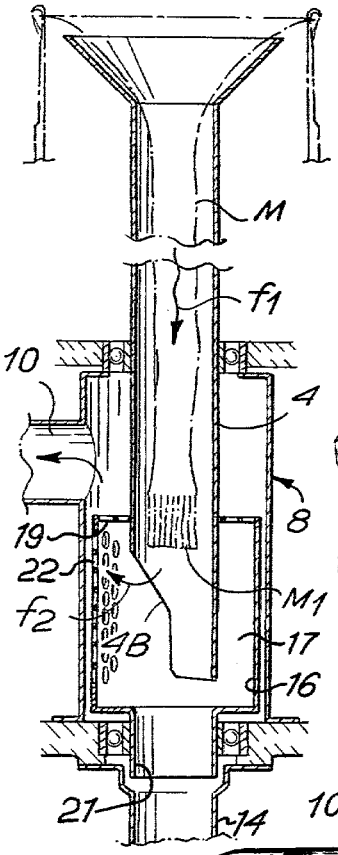
FIG. 3 is a schematic illustration of the components of FIG. 1 shown with an article being knit to the extent that the leading end of the article is in the take-down tube.
Figure 4:
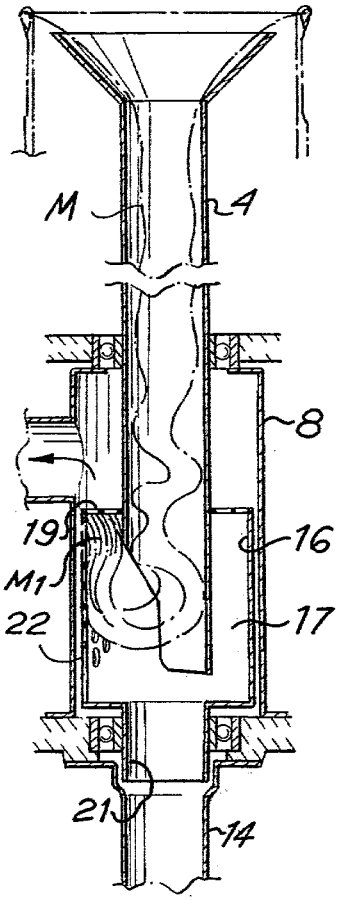
FIG. 4 is a view similar to FIG. 3 showing the article having been knit to a length at which the leading end of the article is in the housing mounted on the take-down tube.
Figure 5:
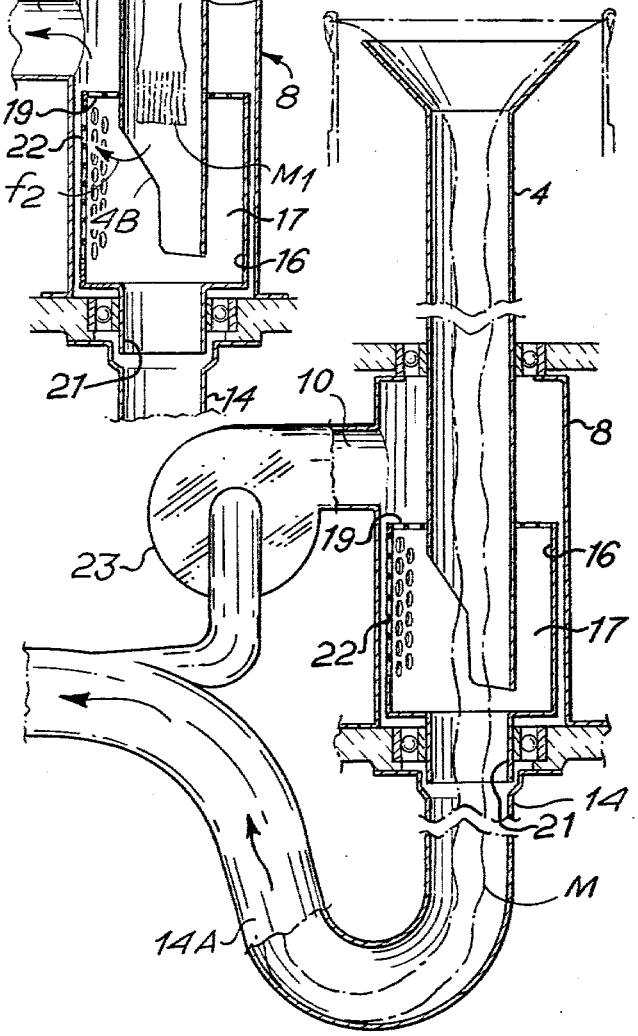
FIG. 5 is a view similar to FIGS. 3 and 4 showing the article extending through the discharge opening and discharge conduit beyond the housing and take-down tube.

Referring to the drawings, the take-down device of the present invention is shown incorporated in the conventinal circular knitting machine of the rotating cylinder type wherein the rotating cylinder 1 carries knitting needles 2 for production of fabric articles M (FIGS. 3, 4 and 5). A cylindrical take-down tube 4 is mounted in the needle cylinder 1 by means of a spacer bracket 3 extending from the inner wall of the needle cylinder to the outer wall of the take-down tube. The tube 4 is substantially smaller than the needle cylinder 1 to facilitate the application of tension by take-down suction on the article M advancing in the tube. To provide a conduit from the needles 2 into the tube 4, the tube is provided with a conical receiving end 4A adjacent the needles 2 and tapering to the main portion of the tube 4. To further enhance the take-down action, a cylindrically reduced portion 24 may be mounted coaxially within the upper end of the take-down tube 4 with a conical receiving end 24A positioned over the corresponding end of the tube.

The tube 4 extends coaxially through the length of the cylinder 1 for rotation therewith, and projects downwardly therebeyond through a stationary base plate 6. A bearing and seal plate 7 is secured to the base plate 6 and surrounds the tube 4 for mounting of an annular elastomeric sealing ring 9 and an annular ball bearing 20 that supports and stabilizes the tube 4 while permitting free rotation thereof with the cylinder. The take-down tube 4 extends downwardly beyond the ball bearing support into a cylindrical casing 8 that is of larger size than the tube for accommodating the disposition at a spacing therein of an article receiving housing 16 that is mounted on the take-down tube 4 for rotation therewith. This housing 16 has an article receiving chamber 17 into which the take-down tube 4 projects and in which the lower end of the tube opens. The housing 16 is formed with an end wall 16A at its upper end and through which the tube projects. This end wall 16A is secured to the tube at an upward spacing from the tube end and is formed with perforations 19 that permit suction to be drawn therethrough. The housing 16 has a cylindrical wall portion 16C that extends coaxially with the take-down tube 4 to a termination below the end of the tube. A bottom plug 16B is mounted in the bottom of the housing 16 and is supported in bearings 18 mounted in a lower suction fitting 12 at the bottom of the aforementioned cylindrical casing 8. In this manner the housing 16 and lower portion of the tube 4 are supported for free rotation with the needle cylinder 1 independent of the stationary casing 8.

The article receiving chamber 17 is enlarged with respect to the take-down tube 4 to provide space for retaining the leading portion of the fabric article as it feeds from the tube into the chamber, and to facilitate this feeding into the chamber and to allow feeding toward the perforations 19, the end of the take-down tube opens transversely, as indicated by the numeral 4B and to further facilitate this feeding into the chamber 17 and retention of the article therein, the wall portion 16C of the housing 16 facing the transverse opening 4B of the tube is provided with perforations 22.

The end of the take-down tube 4 also opens thereacross at its bottom, as indicated by the numeral 4C, adjacent the bottom plug 16B adjacent an article discharge opening 21 in the plug, with the opening 21 being axially aligned with the open end of the tube for in line discharge of articles through said take-down tube 4, housing 16 and discharge opening 21.

Below the article discharge opening 12, an article discharge conduit 14 is secured to a casing 8 and extends downwardly therefrom to an elbow 14A that directs a fabric article therein to a suitable collection location.

Suitable suction producing means, such as a conventional pump, indicated diagrammatically by the reference numeral 23, is connected to a side suction fitting 10 extending laterally from the cylindrical casing 8 above the level of the perforations 19 in the housing end wall 16A to apply suction through the perforations into the housing 16 and take-down tube 4. The suction pump 23 is also connected to the article discharge conduit 14 to create suction therein from the take-down tube 4 and housing 16. This can be accomplished by selectively directing the output of the suction pump into the conduit 14 in a direction away from the take-down tube 4 so that the air flow creates a suction draft upstream in the take-down tube 4, or the intake of the pump 23 can be alternatively shifted to the conduit 14 to draw suction in that manner, with the discharged article being released from the suction in the conduit to fall by gravity or be otherwise transported upon termination of the application of suction to the conduit 14.

The operation of the take-down device of the preferred embodiment is illustrated in FIGS. 3, 4 and 5. In FIG. 3 the means for selectively applying suction, i.e. the pump, is connected to the side suction fitting 10 to draw suction through the take-down tube 4 (arrow f1), housing chamber 17 (arrow f2) perforations 19 and 22, and casing 8. This creates a suction take-down force on the fabric article M as it is being knit by the needles 2 at the upper end of the cylinder 1. This take-down suction continues as the article M is being knit and drawn down through the take-down tube 4 with the leading end M1 of the article progressing down the tube and through the transverse opening 4B into the article receiving chamber 17 toward the perforations 19 and 22. As knitting continues, the suction continues to apply a take-down tension on the article M and the leading portion M1 of the article continues to progress into the housing chamber 17 and be retained therein by the suction through the perforations 19 and 22 (FIG. 4) Thus, an effective take-down tension is being applied and the article is being retained without twisting of the article during the take-down operation even though the article may be considerably longer than the length of the take-down tube 4.

Immediately before completion of the knitting of the article M or at a time slightly in advance of such completion, the pump 23 is switched from the side suction fitting 10 to the article discharge conduit 14, thereby releasing the article M from the suction through the perforations 19 and 22 and drawing the article through the end of the take-down tube in axial alignment through the housing 16, article discharge opening 21 and article discharge conduit 14 (FIG. 5). In this mode, upon release of the article M from the knitting needles 2, the article will be drawn by the suction in the conduit from the tube 4 and through the housing 16 to a suitable collection location to which the conduit 14 is attached.

From the foregoing it is evident that the present invention provides a simple and inexpensive pneumatic take-down device that applies effective tensioning during knitting while retaining the knit fabric in a manner in which there is no disadvantageous twisting and then permits in line discharge upon completion of the knitting operation.

The device of the present invention can be used in knitting machines adapted to perform additional functions, such as closing the toe of stockings knit on the machine, or any other suitable operation. In a toe closing operation the machine could be adapted to close the toes of stockings knit of thermo plastic yarns by gathering the toe end of the stocking at the completion of knitting and treating with a heated element to form a plasticized closure; in such an adaptation the stocking could be released while the cut off portion beyond the toe is retained temporarily at the closing device and is subsequently released separately from the stocking.

It is to be understood that the details of the preferred embodiment illustrated in the accompanying drawings and described in particular hereinabove are provided for illustrative purposes only and that the present invention is not intended to be limited thereby otherwise, except as defined in the appended claims and equivalents thereof.

I claim:

1. A pneumatic take-down device for a circular knitting machine of the rotating cylinder type comprising a take-down tube mounted in the knitting machine cylinder for rotation therewith, a housing mounted on said tube for rotation therewith and having an article receiving chamber therein, said housing having perforations therein, said tube having an end opening transversely into said chamber adjacent said perforations for feeding of articles to said perforations, means for applying suction through said perforations to impose a take-down suction to an article in said tube and to retain in said chamber adjacent said perforations the portion of an article being knit that feeds from said tube into said chamber for rotation thereof with said housing and tube without relative twisting, and said housing having an article discharge opening separate from said perforations for discharge of articles therethrough from said housing upon discontinuance of suction through said perforations.

2. A pneumatic take-down device according to claim 1 and characterized further in that said housing has an end wall through which said tube projects to said tube open end in said chamber, and said perforations are formed in said end wall.

3. A pneumatic take-down device according to claim 1 and characterized further in that said housing includes perforations in a wall portion thereof facing the transverse opening in said tube end.

4. A pneumatic take-down device according to claim 1 and characterized further in that said discharge opening is coaxially aligned with said tube for in line discharge of articles through said tube, housing and discharge opening.

5. A pneumatic take-down device according to claim 4 and characterized further in that said tube end opens thereacross in alignment with said article discharge opening for in line discharge of articles and opens transversely of said tube for feeding of articles to said perforations.

6. A pneumatic take-down device according to claim 1 and characterized further in that said tube has a cylindrically reduced portion adjacent the article receiving end thereof for concentrated article tensioning suction thereat.

* * * * *